United States Patent [19]

Burnett, Jr.

[11] 4,222,147

[45] Sep. 16, 1980

[54] DOOR CLOSER WITH ASSIST OR DOOR OPERATING FEATURES

[75] Inventor: L. Nelson Burnett, Jr., Pottstown, Pa.

[73] Assignee: Reading Door Closer Corp., Reamstown, Pa.

[21] Appl. No.: 888,217

[22] Filed: Mar. 20, 1978

[51] Int. Cl.[2] ..... E05F 3/00

[52] U.S. Cl. ..... 16/62; 16/64; 49/13

[58] Field of Search ..... 16/49, 51, 52, 58, 62, 16/66, 69, 64, 79; 49/13, 30, 26, 29

[56] References Cited

U.S. PATENT DOCUMENTS

| | | | |
|---|---|---|---|
| 2,190,653 | 2/1940 | Dunn . | |
| 2,276,338 | 3/1942 | Potter et al. . | |
| 2,758,835 | 8/1956 | Wikkerink . | |
| 2,900,791 | 8/1959 | Kinsey | 49/30 |
| 3,003,317 | 10/1961 | Schroeder et al. | 49/26 X |
| 3,087,720 | 4/1963 | Catlett . | |
| 3,195,879 | 7/1965 | Bond et al. | 49/30 |
| 3,247,615 | 4/1966 | Kalog | 49/30 |
| 3,269,061 | 8/1966 | Massina . | |
| 3,302,330 | 2/1967 | Loftus | 49/30 |
| 3,319,380 | 5/1967 | Loftus | 49/30 |
| 3,323,255 | 6/1967 | Sweetland et al. . | |
| 3,425,161 | 2/1969 | Catlett et al. . | |
| 3,478,468 | 11/1969 | Martin . | |
| 3,696,462 | 10/1972 | Martin . | |
| 3,729,770 | 5/1973 | Lasier . | |
| 3,874,117 | 4/1975 | Boehm . | |
| 3,875,612 | 4/1975 | Poitras . | |
| 3,934,306 | 1/1976 | Farris . | |
| 4,010,572 | 3/1977 | Peterson | 16/62 X |
| 4,019,220 | 4/1977 | Lieberman . | |
| 4,040,144 | 8/1977 | Lasier | 16/66 |
| 4,050,114 | 9/1977 | Zunkel | 16/51 X |

FOREIGN PATENT DOCUMENTS

| | | |
|---|---|---|
| 1037549 | 7/1966 | United Kingdom . |

*Primary Examiner*—George H. Krizmanich
*Attorney, Agent, or Firm*—Robert C. Podwil

[57] ABSTRACT

Hydraulic door closer apparatus includes means for counter-balancing the bias of a return spring, to either assist in opening the door by reducing the force needed to open, or, in an alternative embodiment and mode of operation, to open the door by over-balancing the bias of the return spring. In the latter mode, a remotely manually operable switch, such as, for example, a so-called palm button, may initiate opening the door.

13 Claims, 6 Drawing Figures

FIG. 1
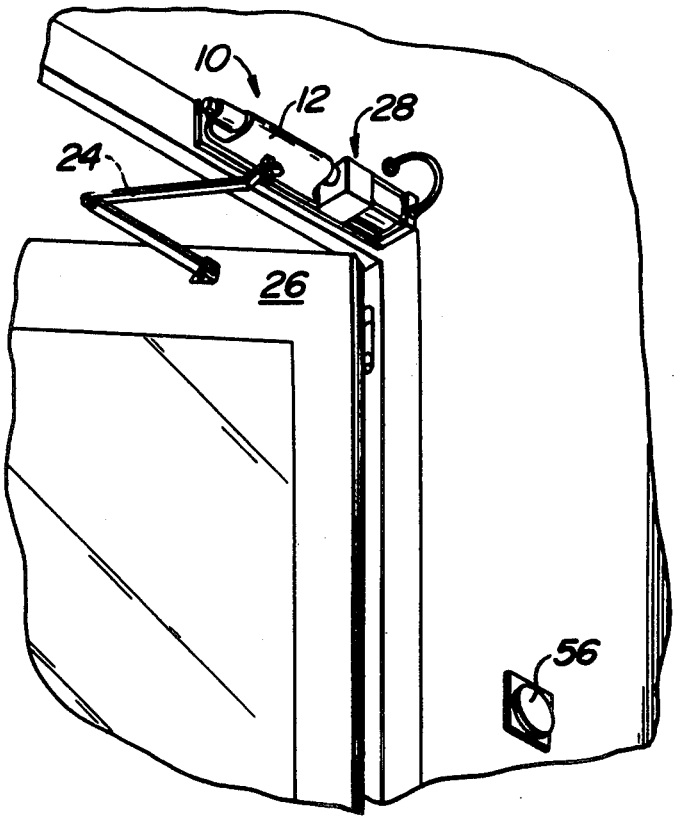
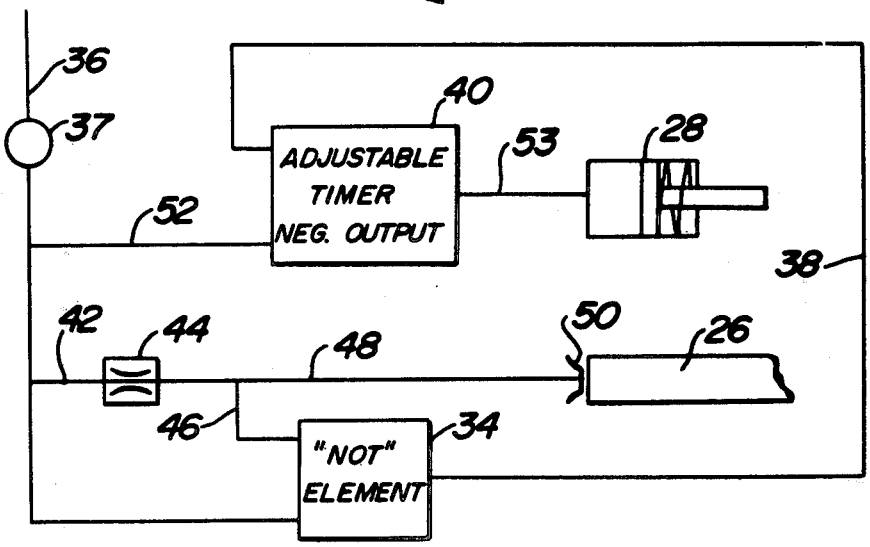
FIG. 4

FIG. 5
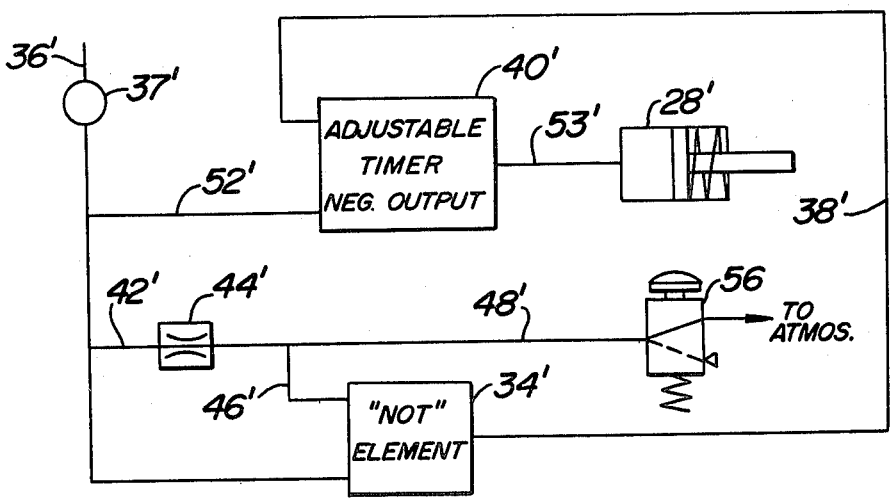
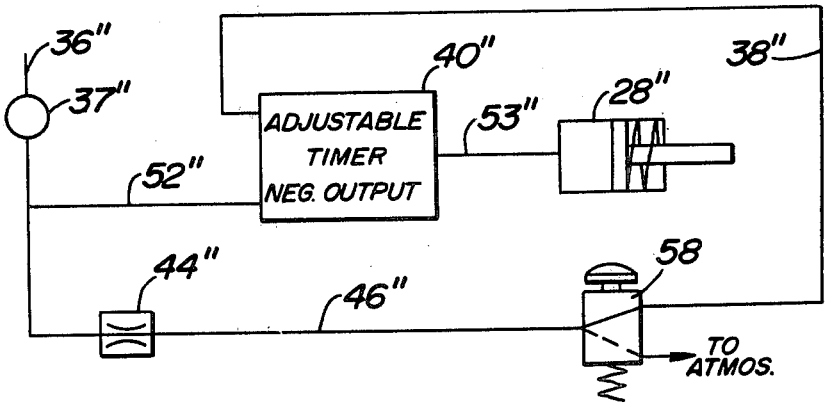
FIG. 6

DOOR CLOSER WITH ASSIST OR DOOR OPERATING FEATURES

BACKGROUND OF THE INVENTION

This invention relates to hydraulic door closer apparatus, and more particularly, to hydraulic door closer apparatus having "assist" or "operating" features to facilitate opening of a door. It relates to the general type of hydraulic door closer illustrated in U.S. Pat. No. 4,019,220 issued Apr. 26, 1977 to Sidney Lieberman, and assigned to the assignee of the present application, in which a spring-urged hydraulic piston is arranged to bias a door to its closed position, with appropriate hydraulic damping. Typically, in the application of apparatus of this sort, a closing force generated by a spring is transmitted between the closer and, depending upon where the closer is mounted, either the door or door frame. For this purpose, it is conventional practice to provide a linkage consisting of one or more links, coupled to the unit and to the door or door frame, as the case may be. In the apparatus shown in U.S. Pat. No. 4,019,220, issued Apr. 26, 1977, a rack and pinion arrangement is used to convert the linear movement of the piston within its cylinder to rotary or oscillating motion of the linkage.

Upon opening of the door, the piston is driven by the pinion against the bias of a return spring and the fluid resistance provided by fluid flow within the device. Movement of the door toward the closed position is caused by unloading of the return spring, and the speed of closing is controlled by appropriate damping provided by the hydraulics.

In certain applications, most notably in the cases of hospitals, old age homes and facilities used by handicapped persons, it is desirable or even required by law that doors normally be closed, yet even the relatively modest opening forces needed to overcome conventional door closers may be excessive for such persons. Indeed, in any facility used by handicapped persons, the resistance to opening generated by conventional closers may be insurmountable.

Apparatus for power-assisted opening of a door, with spring-urged closing, has heretofore been proposed. For example, in U.S. Pat. No. 3,478,468, issued Nov. 18, 1969, to Paul W. Martin, a hydraulic door operating system was proposed in substitution for the familiar hydraulic door closer.

It is the principal object of this invention, however, to provide apparatus in which closing of a door is achieved through the operation of what is essentially a conventional door closer, balanced, or, if desired, overbalanced by a pneumatic actuator associated with it.

It is another object of this invention to provide a mechanically simple door closer, energy efficient in its operation, and relatively easy to install with a minimum of skilled labor, and in particular, requiring no electrical controls.

Other objects will appear hereinafter.

In U.S. Pat. No. 3,875,612, issued Apr. 8, 1975, to Edward J. Poitras, and in numerous others, apparatus has been proposed whereby a door with an associated closer device can be manually moved to selected positions and held there by the action of retained hydraulic fluid, or allowed to close upon the happening of a designated condition.

Also known are devices such as the one shown U.S. Pat. No. 3,934,306 issued Jan. 27, 1976, to Vernie L. Farrix, for a hold-open device, whereby the operation of a door closer is countered until the happening of a contingency such as fire. In accordance with the Farrix, a selectively disengagable brake is operatively associated with the door closer arm, operation of the brake serving to impede closing of the door in response to the urging of the closure.

Such devices do not accomplish the objects of the present invention.

The foregoing and other objects are realized, in a presently preferred form of the invention, by a door closer, essentially conventional in its construction, to which there is assembled a pneumatically controlled and powered actuator, arranged to oppose the biasing force of the return spring of the closer. The door closer in accordance with the invention has a housing providing a cylinder, a piston disposed in the cylinder, and force transmitting means such as a linkage coupled to the piston for transmitting forces to and from the piston. The actuator is coupled to the housing, and applies to the piston forces in opposition to the bias of the return spring.

The actuator in one presently contemplated embodiment of the invention provides an adjustable force sufficient to nearly balance the force of the biasing spring, so that very light forces serve to open the door. In an alternative embodiment, the actuator applies to the piston an adjustable force sufficient to overbalance the biasing force of the spring, thus opening the door in response to operation of the device. In the first case, the so-called "assist" mode, the actuator normally applies a counter-balancing force to the piston, but opening of the door causes a timer to begin operation, which removes the force after an adjustable predetermined interval, thus enabling the closer to operate in the normal fashion to close the door. In the second case, the so-called "operating" mode, the operation of a remotely manually operable switch causes operation of the actuator to overbalance the biasing force of the spring, to open the door. "Timing out" of the timer after release of the switch enables the closer to close the door.

There are seen in the drawings forms of the invention which are presently preferred, it being understood that this invention is not limited to the precise arrangements and instrumentalities shown.

FIG. 1 is a perspective view showing door closer apparatus in accordance with the invention operatively disposed in association with a door.

FIG. 4 is a schematic diagram showing a form of a control system for the apparatus, particularly as used as an assist to door opening.

FIG. 5 is a schematic view of a control system for the apparatus as used in the operating mode, to open a door.

FIG. 6 is a schematic diagram of an alternative form of control system for the apparatus as used in the operating mode.

DETAILED DESCRIPTION

Figure 2:
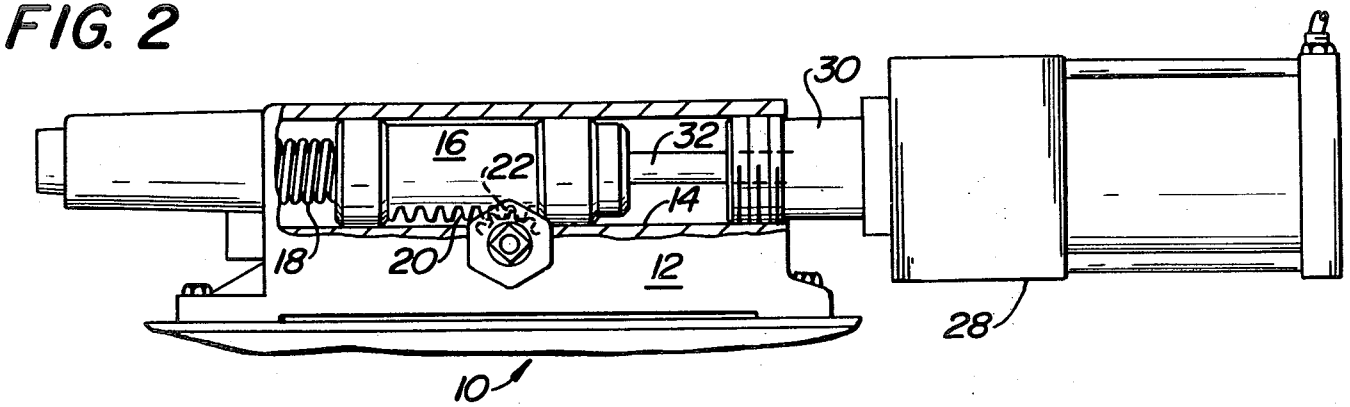
FIG. 2 is a partial cross-sectional view showing a portion of the door closer apparatus in accordance with this invention.
Figure 3:
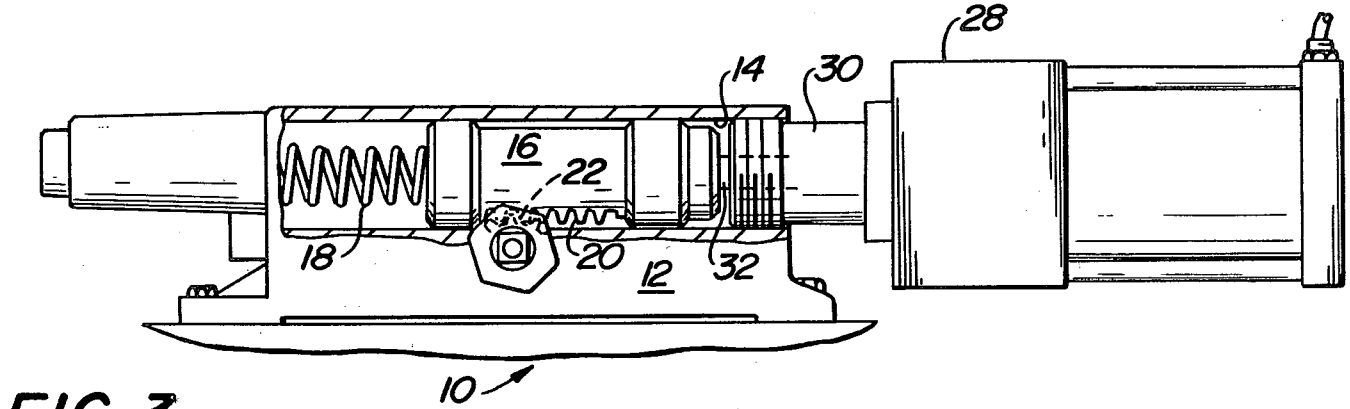
FIG. 3 is a partial cross-sectional view, similar to FIG. 2, but showing the apparatus in a different condition of operation.

Referring now to the drawings in detail, wherein like reference numerals indicate like elements, there is seen in FIG. 1 door closer apparatus designated generally by the reference numeral 10. With reference to FIGS. 2 and 3, the door closer apparatus 10 includes a case or housing 12, provided with a bore 14, in which a piston 16 is slidably disposed.

The housing 12 will be understood by those skilled in the art to have within it suitable fluid passages, not shown, and adjustable valves associated with the passages to control fluid flow within them.

Received within the bore 14 is a return spring 18 associated with the above-mentioned piston 16.

It will be understood that the piston 16 is reciprocable within the bore 14, and that the bore 14 is ordinarily filled with fluid. A rack 20 associated with the piston 16 engages a pinion 22 which is pivotably mounted, by suitable means, not shown, in housing 12.

A suitable linkage 24 interconnects the pinion 22 and a door 26 with which the apparatus 10 is associated. Thus, the pinion 22 and control linkage 24 serve to transmit forces to and from the piston 16 to control movement of the door 26.

Referring again to FIGS. 2 and 3, there is associated with the piston 16 an actuator, designated generally by the reference numeral 28, coupled to the piston in such a manner as to be able to apply force to the piston 16 in opposition to the bias of the return spring 18. In the illustrated form of the invention, a portion 30 of the actuator 28 serves to seal an end of the bore 14, and provides a simple and efficient mounting means coupling the actuator 28 to the housing 12. The actuator 28 in the illustrated and preferred form of the apparatus, is a pneumatic actuator.

A piston rod 32, coupled to a piston (not shown) of the actuator 28, extends through the portion 30 of the actuator 28, and into engagement with a face of the piston 16. Thus, the application of force through the piston rod 32 will transmit, by direct contact with the piston 16, a force to the piston 16 in a direction parallel to the axis of the cylinder 12 and piston 16, in opposition to the bias of the return spring 18.

It should be evident that the application through the piston 16 of forces insufficient to overbalance the force of the return spring 18 may nevertheless significantly lessen the amount of additional force needed to move the piston 16 against the bias of the return spring 18. When the apparatus 10 is configured to provide such a force to the piston 16, it is said to be in the "assist" mode, that is, in a condition in which the apparatus assists opening of the door 26, but does not in fact open it.

When the apparatus 10 is configured to overbalance the force of the return spring 18, operation of the actuator 28 will serve to open the door. In this condition, the unit may be described as being in an "operating" mode.

Referring now to FIG. 4, there is seen, in schematic, a pneumatic circuit by which the actuator 28 may be controlled to assist door opening.

The reference numeral 34 in the Figure designates a so-called "NOT" pneumatic logic element, that is, an element which operates as a valve, and permits the passage of air through it in the absence of a control signal. The NOT element 34 is coupled to a source of filtered and regulated air through a supply conduit 36 and regulator 37, and by a second conduit 38 is connected to a timer element 40 which will shortly be described in greater detail. In installations using several doors, the supply conduit 36 will ordinarily be a common supply for all installations.

Tapped from the conduit 36 is a conduit 42 containing a pressure reducing orifice 44. The orifice 44 reduces the pressure in the conduit 36 to a control pressure for the NOT element, less than the pressure in the conduit 36. Downstream of the orifice 44 there is a conduit 46, supplying the control input to the NOT element 34, and a conduit 48, in which there is placed a door position-sensing bleed valve 50. When closed, the door 26 so obstructs the bleed valve 50 as to effectively close it, thus normally maintaining pressure in the conduits 46 and 48, and causing the NOT element 34 to obstruct the conduit 38 and leave it unpressurized.

The timer element 40 receives through a conduit 52 pressure from the conduit 36, and, in the absence of a control signal from the NOT element (manifested by pressure in the conduit 38) passes pressure to the actuator 28 through a conduit 53. Thus, the timer element 40 may be categorized as a "negative output" timer, in the sense that it normally allows an output in the absence of a control signal.

Application of a control signal to the timer element 40 causes the timer element 40 to time out after an adjustable period of time, and timing out of the timer element 40 cuts off pressure to the actuator 28 and permits the actuator 28 to exhaust.

The operation of the apparatus 10 in the assist mode should now be apparent: at the start of an operative cycle, the door 26 will be closed, and consequently, the bleed valve 50 closed and the conduits 46 and 48 pressurized. Thus, with a signal applied to the NOT element, no signal passes to the timer element 40. Hence, the "negative output" timer element 40 passes air to the actuator 28 to assist door opening in the above-described manner. As the door 26 is opened, however, the bleed valve 50 is opened, and pressure in the conduits 46 and 48 is lost. In the absence of the control signal in the conduit 46, the NOT element passes air to the conduit 38, thus applying a signal to the timer element 40. The application of such a signal starts timing of the timer element 40, and after the adjustable time interval, the timer element 40 times out, to exhaust the actuator 28 and allow the door 26 to close normally. When the door 26 is again closed, the bleed valve 50 is again covered; the NOT element is again provided with a control signal and therefore blocks flow of air in the conduit 38; the timer element 40 again allows flow in the absence of the control signal; and the actuator 28 is again pressurized to provide assist.

By way of illustration, with one presently contemplated form of door closer, air at 30 p.s.i. counterbalances the force of the return spring 18 to the extent that the door can be opened upon the application of only approximately one pound of force near its outer edge, normal unassisted opening force being on the order of twelve to sixteen pounds. The residual one pound force resists opening of the door by air currents, as would occur if the return spring were perfectly balanced.

Referring now to FIG. 5, a modified form of the invention is illustrated, wherein elements corresponding to those previously described are designated by like primed (') reference numerals.

The apparatus 10' is so configured and arranged as to provide for operation of a door, rather than mere assist, and operates in response to a remote command. In FIG. 5, there is seen a manual switch element 56, which in its normal, unactuated condition, permits air in the conduit 48' to vent to atmosphere.

Absence of control pressure in the conduit 46' causes the NOT element 34' to pass pressure through the conduit 38' to the timer element 40'. With the application of a control signal to the timer element 40', no pressure is passed to the actuator 28'.

Upon actuation of the switch element 56, however, to interrupt bleeding of pressure in the conduit 48' to atmosphere, a signal is applied to the NOT element 34', and control pressure to the timer element 40' (through the conduit 38') is interrupted. The timer element 40' then passes pressure to the actuator 28'.

As long as the switch element 56 is actuated, flow to the actuator 28' continues, but upon release of the switch element 56, the control signal to the NOT element 34' is lost, and the NOT element 34' again passes pressure to the conduit 38' and the timer element 40'. The timer element 40', after a pre-determined adjustable interval, presently preferred to be on the order of about 20 seconds, then times out, and causes the actuator 28' to be exhausted, thus allowing the door to close in response to the influence of the return spring 18' of the apparatus 10'.

The pressure applied to the actuator 28' in the "operating" mode, it will be understood, must be higher than that used in the "assist" mode, this being so because the force to be applied by the actuator must, in the operating mode overbalance the force of the return spring 18'. The force applied by the actuator 28, 28' is, of course, a function of the size of the actuator piston and the operating pressure. In one present operative embodiment using a three-inch diameter piston, pressures in the range of about 40 to 70 p.s.i. may be used in the operating mode. Speed of operation in the operating mode is a function of pressure, with higher pressures providing, in general, faster and more abrupt operation.

Referring now to FIG. 6, an alternative form of the apparatus in the "operating" mode is illustrated, this form of the apparatus having the energy-saving advantage over the embodiment shown in FIG. 5 of not venting air in its steady state. Referring to FIG. 6, a switch element 58 similar to the above-described switch element 56, normally receives air through conduits 36" and 46", and passes it through the conduit 38" to a timer element 40". No NOT element is used or needed as in the former embodiment.

Upon actuation of the switch element 58, pressure in the conduit 46" is vented to the atmosphere, and loss of the signal through the conduit 38" to the timer element 40" causes the timer element 40" to pass air to the conduit 52" and actuator 28". Release of the switch element 58 causes the timer element 40" to time out after the preselected interval.

The switch elements 56 and 58 are, in the illustrated embodiments of the invention so-called "palm buttons" positioned on or near walls or door frames adjacent to the door to be operated by the apparatus 10' or 10" as the case may be. thus, a wheelchairbound patient, for example, approaching the door need only operate the switch element 56 or 58, to effect opening of the door. Other well-known elements, such as mats, treadles, push bars, pneumatic sensors or electric eye sensors might also be used.

The NOT element 34, 34' and timer element 40, 40', 40" may be any suitable commercially available parts. In present operative embodiments, the products sold by Miller Fluid Power, of Bensenville, Illinois, under its Parts Nos. 50 4065 and 50 6620 have been found satisfactory.

It is an advantage of all three embodiments of the above-described invention that the doors are normally closed, as is desirable or necessary in some applications. Thus, the present invention, in each of its forms, is distinguishable from known prior art devices in which a door is held open, but released either manually or in response to some condition, such as a fire or smoke alarm, and also from devices which simply operate to hold a door open subject to the operation of the closer.

The present invention may be embodied in other specific form without departing from its spirit or essential attributes, and, accordingly, reference should be made to the appended claims rather than the foregoing specification as indicating the scope of the invention.

I claim:

1. Hydraulic door closer apparatus comprising a housing having a cylinder therein, a piston disposed in said cylinder, force transmitting means operatively coupled to said piston for transmitting forces to and from said piston to control movement of a door, biasing means in said cylinder in force-transmitting engagement with said piston for biasing said piston toward a rest position, actuator means operatively coupled to said piston for selectively applying to said piston force in opposition to said biasing means, and control means operatively coupled to said actuator means for selectively operating said actuator means, said actuator means being so configured and arranged as to be capable of providing a force in excess of the force of said biasing means, and said control means comprising means coupled to said actuator means for normally causing said actuator means to provide a force in opposition to said biasing means approximately equal to the force of said biasing means so that the effect of said biasing means is nearly balanced and manual opening of a door facilitated thereby, and said control means further comprising selectively operable means for selectively causing said actuator means to provide a force in opposition to said biasing means in excess of the force of said biasing means so that the force of said biasing is overbalanced and the door caused to be opened.

2. Apparatus in accordance with claim 1 wherein said actuator means is a fluid actuator of the pneumatic type, and said control means comprises fluid circuit means.

3. Apparatus in accordance with claim 1, wherein said actuator means is normally inoperative, timer means coupled to said actuator means to render said actuator means inoperative upon sensing by said timer means of the lapse of a preselected time interval, and said selectively operable means comprises remotely manually operable valve means operatively coupled to said timer means for triggering operation of said timer means and said actuator means.

4. Apparatus in accordance with claim 3, wherein said remotely manually operable valve means comprises a palm button.

5. Apparatus in accordance with claim 3, wherein said actuator means is a fluid actuator of the pneumatic type, and said remotely operable means comprises a source of air pressure, conduit means coupled to said source and said actuator means, and said remotely manually operable valve means being operatively associated with said conduit and positioned and arranged to selectively place said actuator means in fluid communication with said source.

6. Apparatus in accordance with claim 5, wherein said remotely manually operable valve means includes a normally closed vent, opening of said vent triggering said timer means.

7. Apparatus in accordance with claim 5, wherein said remotely manually operable valve means comprises a palm button.

8. Hydraulic door closer apparatus comprising a housing having a cylinder therein, a piston disposed in said cylinder, force transmitting means operatively coupled to said piston for transmitting forces to and from said piston to control movement of a door, biasing means in said cylinder in force-transmitting engagement with said piston for biasing said piston toward a rest position, actuator means operatively coupled to said piston for selectively applying to said piston force in opposition to said biasing means, said actuator means being secured to said housing and including a force-transmitting member in force-transmitting engagement with said piston and operable in a direction parallel to the axis of said cylinder and said piston to oppose said biasing means, said actuator means being so configured and arranged as to provide a force approximately equal to the force of said biasing means so that the effect of said biasing means may be nearly balanced and manual opening of a door facilitated thereby, said actuator means being a fluid actuator of the pneumatic type, and control means operatively coupled to said actuator means for selectively operating said actuator means, said control means comprising a source of air pressure, conduit means coupled to said source and said actuator means, and door position responsive means operatively associated with said conduit means for selectively placing said actuator means in fluid communication with said source, said position responsive means comprising time-responsive valve means for placing said actuator means in fluid communication with said source when the door is closed and interrupting the fluid communication when said time-responsive valve means times out, and second valve means responsive to door position and operatively coupled to said time-responsive valve means and said source so that actuation of said second valve means in response to opening of the door causes said time-responsive valve means to operate said time-responsive valve means, said time-responsive valve means having means for venting said actuator means to atmosphere when said time-responsive valve means is timed out, so that said actuator means is rendered inoperative when said time-responsive valve means is timed out.

9. Apparatus in accordance with claim 3, wherein said second valve means comprises a control element adapted to pass air only in the absence of a control signal, and normally closed vent means responsive to door position and providing a control signal to said control element only when the door is closed, so that opening of the door causes actuation of said second valve means and operation of said time-responsive valve means.

10. Hydraulic door closer apparatus comprising a housing having a cylinder therein, a piston disposed in said cylinder, force transmitting means operatively coupled to said piston for transmitting forces to and from said piston to control movement of a door, biasing means in said cylinder in force-transmitting engagement with said piston for biasing said piston toward a rest position, actuator means operatively coupled to said piston for selectively applying to said piston force in opposition to said biasing means, and control means operatively coupled to said actuator means for selectively operating said actuator means, said actuator means being secured to said housing and including a force-transmitting member in force-transmitting engagement with said piston and operable in a direction parallel to the axis of said cylinder and said piston to oppose said biasing means, said actuator means being so configured and arranged as to provide a force in excess of the force of said biasing means so that the effect of said biasing means may be overbalanced, said actuator means being normally inoperative, timer means coupled to said actuator means to render said actuator means inoperative upon sensing by said timer means of the lapse of a preselected time interval, and remotely manually operable valve means operatively coupled to said timer means for triggering operation of said timer means and said actuator means, said remotely manually operable valve means comprising a control element adapted to pass air only in the absence of a control signal, and a normally opened vent means associated with said remotely manually operable valve means and providing a control signal to said control element upon the closing thereof, said control signal triggering operation of said timer means.

11. Apparatus in accordance with claim 10, wherein said remotely manually operable valve means comprises a palm button.

12. Hydraulic door closer apparatus comprising a housing having a cylinder therein, a piston disposed in said cylinder, force transmitting means operatively coupled to said piston for transmitting forces to and from said piston to control movement of a door, biasing means in said cylinder in force-transmitting engagement with said piston for biasing said piston toward a rest position, actuator means operatively coupled to said piston for selectively applying to said piston force in opposition to said biasing means, and control means operatively coupled to said actuator means for selectively operating said actuator means, said actuator means being secured to said housing and including a force-transmitting member in force-transmitting engagement with said piston and operable in a direction parallel to the axis of said cylinder and said piston to oppose said biasing means, said actuator means being so configured and arranged as to provide a force approximately equal to the force of said biasing means so that the effect of said biasing means may be nearly balanced and manual opening of a door facilitated thereby, said actuator means being normally operative, timer means coupled to said actuator means to render said actuator means inoperative upon sensing by said timer means of the lapse of a preselected time interval, and said control means comprising means operatively coupled to said timer means and responsive to door position for triggering operation of said timer means.

13. Hydraulic door closer apparatus comprising a housing having a cylinder therein, a piston disposed in said cylinder, force transmitting means operatively coupled to said piston for transmitting forces to and from said piston to control movement of a door, biasing means in said cylinder in force-transmitting engagement with said piston for biasing said piston toward a rest position, actuator means operatively coupled to said piston for selectively applying to said piston force in opposition to said biasing means, and control means operatively coupled to said actuator means for selectively operating said actuator means, said actuator means being secured to said housing and including a force-transmitting member in force-transmitting engagement with said piston and operable in a direction parallel to the axis of said cylinder and said piston to oppose said biasing means, said actuator means being so configured and arranged as to provide a force approximately equal to the force of said biasing means so that the effect of said biasing means may be nearly balanced and manual opening of a door facilitated thereby, said actuator means being a fluid actuator of the pneumatic type, and said means coupled to said actuator means comprising a source of air pressure, conduit means coupled to said source and said actuator means, and door position responsive means operatively associated with said conduit means for selectively placing said actuator means in fluid communication with said source.

* * * * *